US006237758B1

(12) United States Patent
Hsu

(10) Patent No.: US 6,237,758 B1
(45) Date of Patent: May 29, 2001

(54) STACKABLE CONTAINER CASE

(75) Inventor: Roger S. Hsu, Torrance, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/679,245

(22) Filed: Oct. 4, 2000

Related U.S. Application Data

(62) Division of application No. 09/309,932, filed on May 11, 1999, now Pat. No. 6,131,730.

(51) Int. Cl.[7] ..... B65D 71/00

(52) U.S. Cl. ..... 206/203; 206/480; 206/427; 206/485; 206/486; 206/503; 206/507

(58) Field of Search ..... 206/203, 480, 206/486, 485, 427, 503, 507

(56) References Cited

U.S. PATENT DOCUMENTS

| | | |
|---|---|---|
| D. 313,493 | 1/1991 | Apps et al. . |
| D. 317,670 | 6/1991 | Apps . |
| D. 319,129 | 8/1991 | Apps et al. . |
| D. 322,917 | 1/1992 | Morris et al. . |
| D. 327,357 | 6/1992 | Rehrig . |
| D. 327,972 | 7/1992 | Apps et al. . |
| D. 330,621 | 10/1992 | Apps . |
| D. 348,344 | 6/1994 | Apps . |
| D. 355,764 | 2/1995 | Apps . |
| D. 356,211 | 3/1995 | Apps et al. . |
| D. 356,679 | 3/1995 | Apps et al. . |
| D. 361,431 | 8/1995 | Koefelda . |
| D. 361,663 | 8/1995 | Kalin . |
| D. 379,717 | 6/1997 | Apps et al. . |
| D. 380,901 | 7/1997 | Apps et al. . |
| 2,512,855 | 6/1950 | Erickson . |
| 2,526,335 | 10/1950 | Deichert . |
| 2,530,481 | 11/1950 | Rawn, Jr. . |
| 3,055,531 | 9/1962 | Chelbor . |
| 3,392,869 | 7/1968 | Needt . |
| 3,416,694 | 12/1968 | Bebb . |
| 3,428,207 | 2/1969 | Schoeller . |
| 4,162,738 | 7/1979 | Wright . |
| 4,372,598 | 2/1983 | Quelch . |

(List continued on next page.)

FOREIGN PATENT DOCUMENTS

| | | |
|---|---|---|
| 1 350 962 | 1/1963 | (FR) . |
| 2 302 244 | 2/1975 | (FR) . |
| 758 517 | 10/1956 | (GB) . |

*Primary Examiner*—Joseph M. Moy
(74) *Attorney, Agent, or Firm*—Brooks & Kushman P.C.

(57) ABSTRACT

A stackable case for retaining and transporting containers having radially outward projecting lids includes a bottom panel member having a lower surface and an upper surface with a plurality of container support areas therein. It further includes a pair of opposing side walls and a pair of opposing end walls integrally formed with and projecting upward from the bottom panel member, the side walls having a lower wall portion and a plurality of spaced upwardly projecting pylons which includes four corner pylons defining four corners of the case. The lower wall portion has a plurality of raised projections disposed thereon which define a lower plane sufficiently spaced from the upper surface of the bottom panel member to receive the lid of the container securely therebetween. Also included is at least one column member which is upwardly projecting from the bottom panel member and defines, in combination with the bottom panel member, the pair of opposing side walls, the pair of opposing end walls, and the container support areas, a plurality of container retention pockets.

9 Claims, 12 Drawing Sheets

U.S. PATENT DOCUMENTS

| | | | | |
|---|---|---|---|---|
| 4,538,742 | | 9/1985 | Prodel . | |
| 4,735,313 | | 4/1988 | Schoenberg . | |
| 4,899,874 | | 2/1990 | Apps et al. . | |
| 4,911,300 | | 3/1990 | Colonna . | |
| 4,911,303 | | 3/1990 | Andersson . | |
| 4,928,841 | * | 5/1990 | Arthurs | 206/203 |
| 4,932,532 | | 6/1990 | Apps et al. . | |
| 4,978,002 | | 12/1990 | Apps et al. . | |
| 5,002,186 | | 3/1991 | Cooper . | |
| 5,060,819 | | 10/1991 | Apps . | |
| 5,096,085 | | 3/1992 | Eek et al. . | |
| 5,105,948 | | 4/1992 | Morris et al. . | |
| 5,184,748 | | 2/1993 | Apps . | |
| 5,230,601 | | 7/1993 | Apps et al. . | |
| 5,248,035 | | 9/1993 | Gallagher . | |
| 5,267,649 | | 12/1993 | Apps et al. . | |
| 5,277,316 | | 1/1994 | Apps et al. . | |
| 5,285,899 | | 2/1994 | Apps et al. . | |
| 5,305,884 | | 4/1994 | Apps et al. . | |
| 5,316,172 | | 5/1994 | Apps et al. . | |
| 5,320,245 | | 6/1994 | Apps et al. . | |
| 5,323,925 | | 6/1994 | Apps . | |
| 5,351,814 | | 10/1994 | Apps . | |
| 5,405,042 | | 4/1995 | Apps et al. . | |
| 5,445,273 | | 8/1995 | Apps . | |
| 5,465,843 | | 11/1995 | Koefelda . | |
| 5,495,945 | | 3/1996 | Apps et al. . | |
| 5,501,352 | | 3/1996 | Apps . | |
| 5,507,543 | | 4/1996 | Shefflin . | |
| 5,529,176 | | 6/1996 | Apps et al. . | |
| 5,575,390 | | 11/1996 | Apps et al. . | |
| 5,651,461 | | 7/1997 | Apps et al. . | |
| 5,660,279 | | 8/1997 | Apps et al. . | |
| 5,704,482 | | 1/1998 | Apps et al. . | |
| 5,842,572 | | 12/1998 | Apps et al. . | |
| 5,855,277 | | 1/1999 | Apps et al. . | |
| 5,938,011 | * | 8/1999 | Holzapfel et al. | 206/203 |
| 6,079,554 | * | 6/2000 | Hammett et al. | 206/203 |

* cited by examiner

STACKABLE CONTAINER CASE

"This is a divisional of application Ser. No. 09/309,932, filed on May 11, 1999 now U.S. Pat. No. 6,131,730."

TECHNICAL FIELD

The present invention relates to a stackable container case for use in retaining and transporting cans and other containers.

BACKGROUND OF THE INVENTION

During the transport of containers such as canned goods, jostling and rough handling of the packaging may occur. Under these circumstances, the containers may potentially become dislodged from the packaging and become dented or otherwise damaged. Even in the absence of rough handling it may be easier or convenient—depending on the person transporting the containers—to carry the same at an angle away from horizontal. For example, if the person transporting the goods has two cases of canned goods, instead of making two trips, the person may lift one case in each hand. Again, however, the possibility arises that the containers may become dislodged from the packaging. Prior art cases are also formed of corrugated paperboard which typically does not have a long life, even under normal wear and especially when exposed to harsh environmental conditions. Such paperboard cases are often scrapped and are otherwise not re-usable long term.

Consequently, containers such as an improved packaging or case is desired for containers such as canned goods, bottles and other packaged foodstuffs, which is reasonably inexpensive, lightweight and sturdy. The improved case should be able to retain the containers therein given reasonable rough handling and transport. The improved case should also have sufficient stiffness to support the handling and retention of the containers therein. The case should also be easily stored and transported, with and without goods therein. The case should also be reusable and have a long-term use life.

SUMMARY OF THE INVENTION

It is an object according to the present invention to provide an improved stackable case with high stability for stored containers, full label visibility for display purposes, an easily gripped handle structure, a stable cross-stacking ability, and improved structural integrity for long life.

It is another object according to the present invention to provide an improved stackable case in which containers are securely retained therein during shipping and transport. The case is also designed to be nested with other similar cases which have no containers retained therein, for ease of storage.

These and other problems of the prior art are overcome by the stackable can case according to the present invention. The present invention provides a stackable case in which a handle structure is provided at opposing ends thereof which may be freely grasped about substantially the entire periphery thereof, and an integrally molded structural reinforcement member is provided below each handle for increased structural integrity, and is spaced sufficiently away from the respective handle structure to prevent interference with the grasping of the handle structure.

The stackable case for retaining and transporting containers also has opposing side walls and opposing end walls that form an outer shell having a bottom panel disposed substantially within the outer shell. The side walls include a lower wall portion and a plurality of spaced upwardly projecting pylons, including four corner pylons defining four corners of the case. A plurality of spaced upwardly projecting columns is generally disposed within the outer shell and defines, in combination with the bottom panel, the side walls and the end walls, a plurality of can retaining pockets. The end walls each include an integrally molded handle structure suspended proximate to the end wall between an upper portion of adjacent corner pylons to thereby defines a generally open end wall area below the handle structure. The end walls further include an integrally molded structural reinforcement member extending between the adjacent corner pylons below the respective handle structure and sufficiently spaced away from the respective handle structure to prevent interference with the grasping of the handle structure.

The integrally molded structural reinforcement member adds significant structural integrity to the case, thereby improving the durability and useful life of the case.

One or more retention members such as raised ribs are also integrally provided on the side walls and/or pylons of the case. These retention members provide the case with additional torsional strength and also provide an interference fit for containers retained in the case. Moreover, the retention member on the lower side walls define a recess with the bottom panel in order to securely receive therein a protruding portion of a container such as a lip of a can or the bulbous bottom portion of a bottle.

The above objects and other objects, features and advantages of the present invention are readily apparent from the following detailed description of the best modes for carrying out the invention when taken in connection with the accompanying drawings.

BRIEF DESCRIPTION OF THE DRAWINGS

FIGS. 13*a*–13*c* are top views, wherein FIG. 13*a* illustrates a pallet having two layers of cases (of FIGS. 13*b*–13*c*) having containers retained therein in a stacked and cross-stacked orientation.

DETAILED DESCRIPTION OF THE PREFERRED EMBODIMENTS

With reference to FIGS. 1–5, a stackable container case 10 in accordance with the present invention is illustrated therein and adapted to receive and retain cans such as No. 10 cans. It is understood, however, that case 10 may be adapted to receive and retain any suitable container including without limitation, bottles and a variety of different sized cans.

Figure 1:
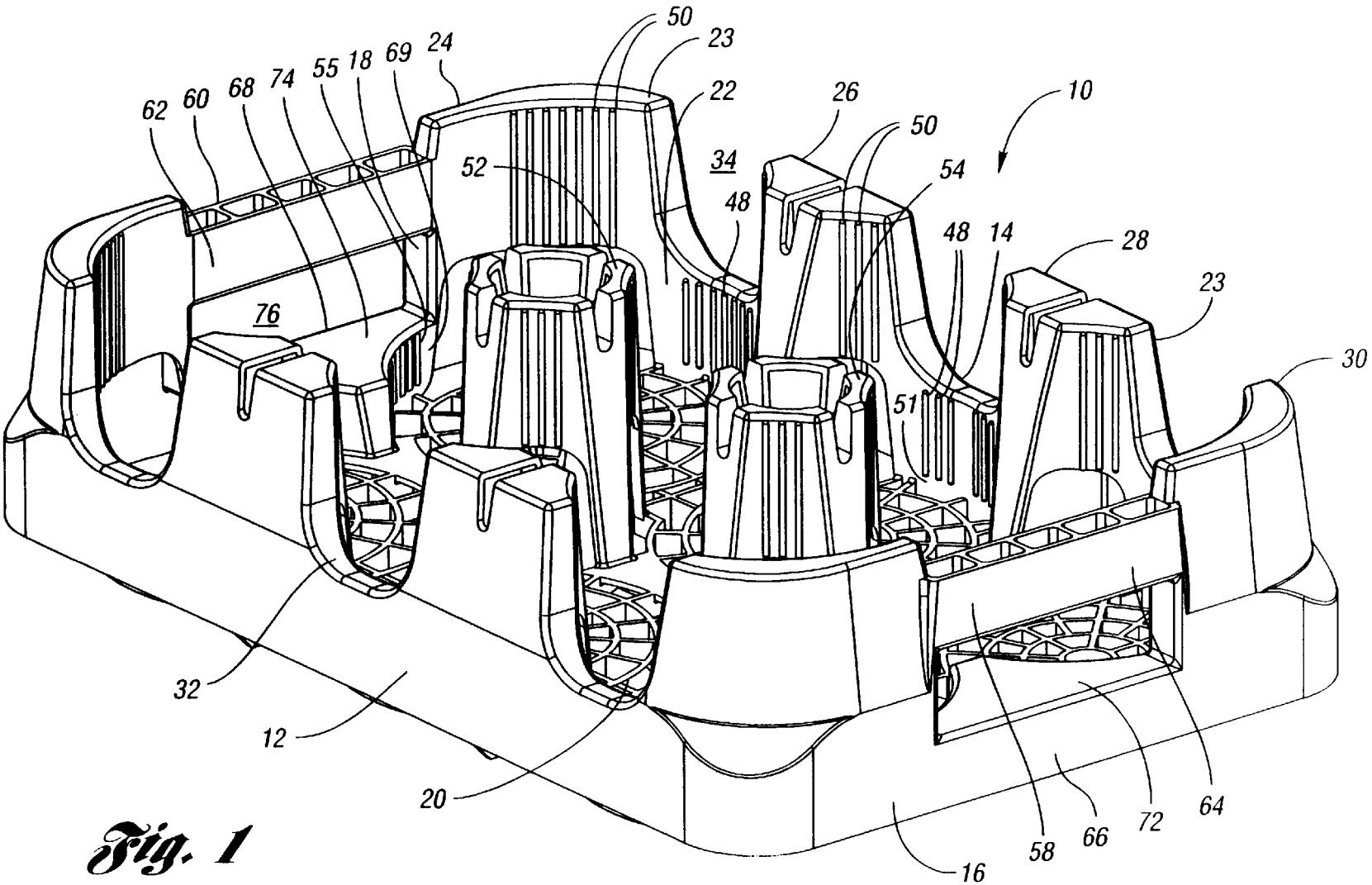
FIG. 1 shows a perspective view of a stackable container case according to the present invention.

With particular reference to FIG. 1, case 10 is preferably but not necessarily a low depth case and includes side walls 12, 14, and opposing end walls 16,18 which cooperate to form an outer shell. Case 10 also includes bottom wall 20 which is disposed substantially within the outer shell. Side walls 12,14 are relatively long and extend the length of the case 10, whereas end walls 16,18 are relatively short and extend the width of the case 10. Case 10 is generally rectangular and is, therefore, symmetric about both centerlines which bisect the bottom surface. The depth or height of side walls 12,14 and end walls 16,18 is relatively low compared to the height of the can retained therein. The ratio of the length of side walls 12,14 to the length of end walls 16,18 is substantially equal to the ratio of the number of cans the case holds in the lengthwise direction to the number of cans the case holds in the widthwise direction. For example, a six-container case is approximately 1.5 times as long as it is wide and holds cans in a 3×2 relationship.

Figure 4A:
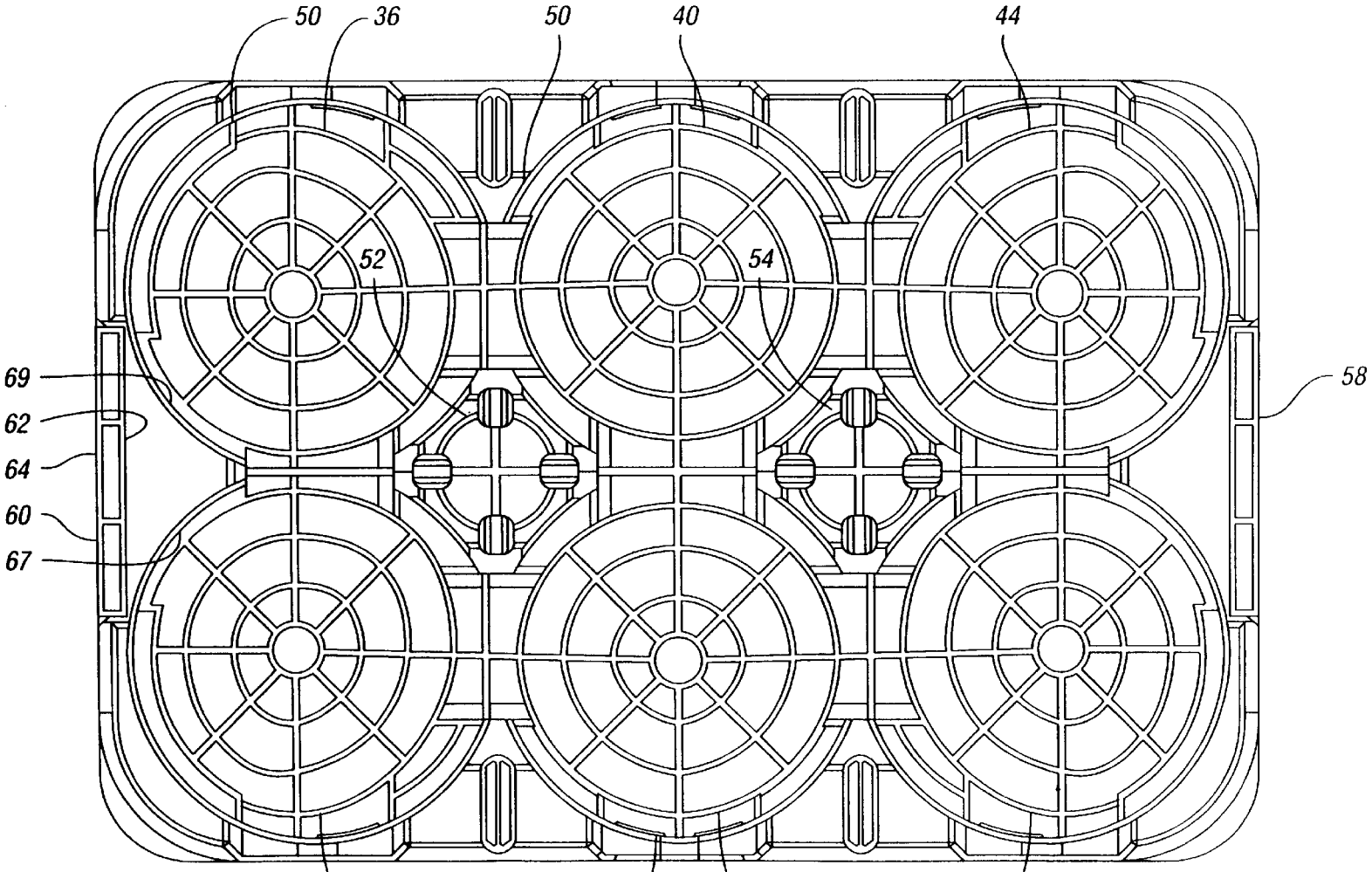
FIG. 4*a* shows a top plan view of the case of FIG. 1.
Figure 4B:
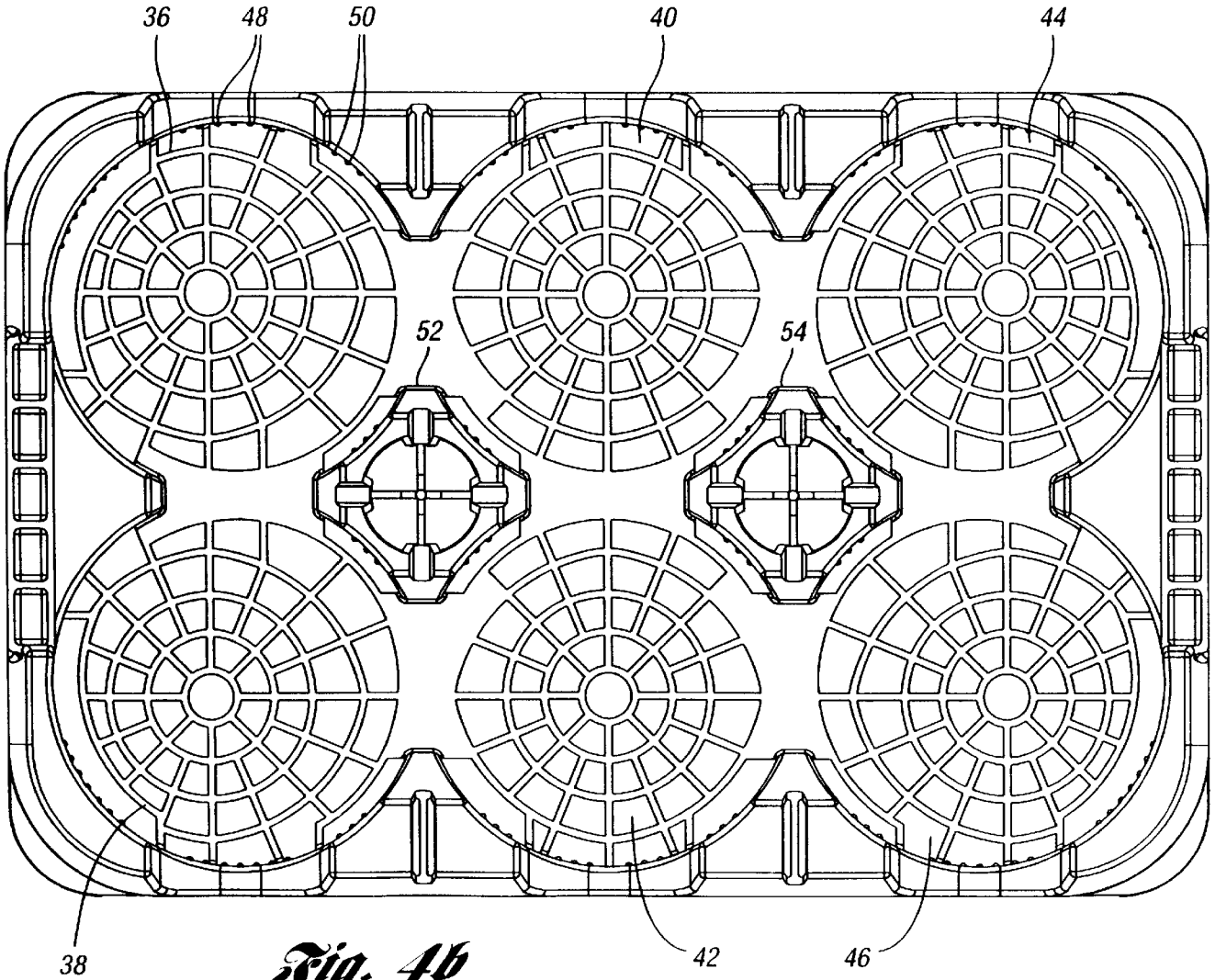
FIG. 4*b* shows an enlarged top plan view similar to that shown in FIG. 4*a;*
Figure 5:
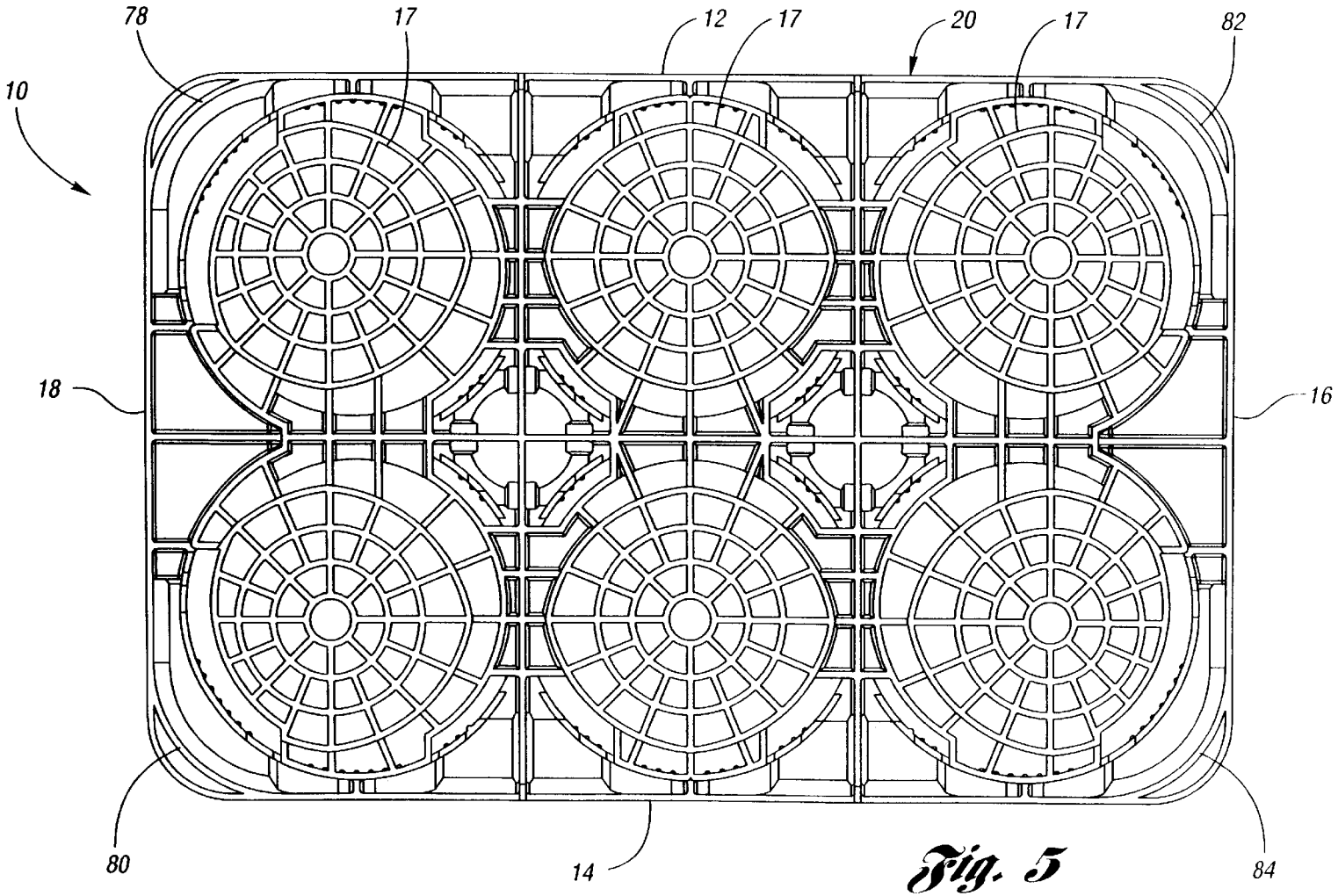
FIG. 5 shows a bottom plan view of the case of FIG. 1.

As best shown in FIGS. 4*a*–*b* and 5, the floor structure or bottom panel 20 (or member) is attached to side walls 12,14 and end walls 16,18 to form the outer shell of the case 10. Preferably, case 10 is made from plastic and is molded integrally as a unitary structure.

Figure 2:
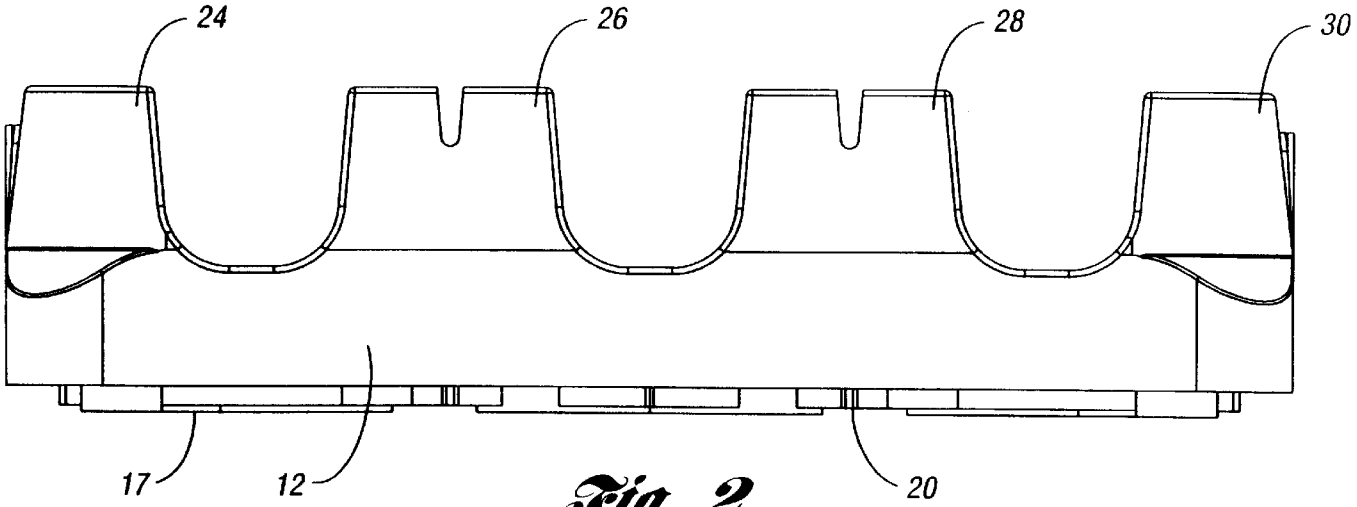
FIG. 2 shows a side elevational view of the case of FIG. 1.
Figure 12:
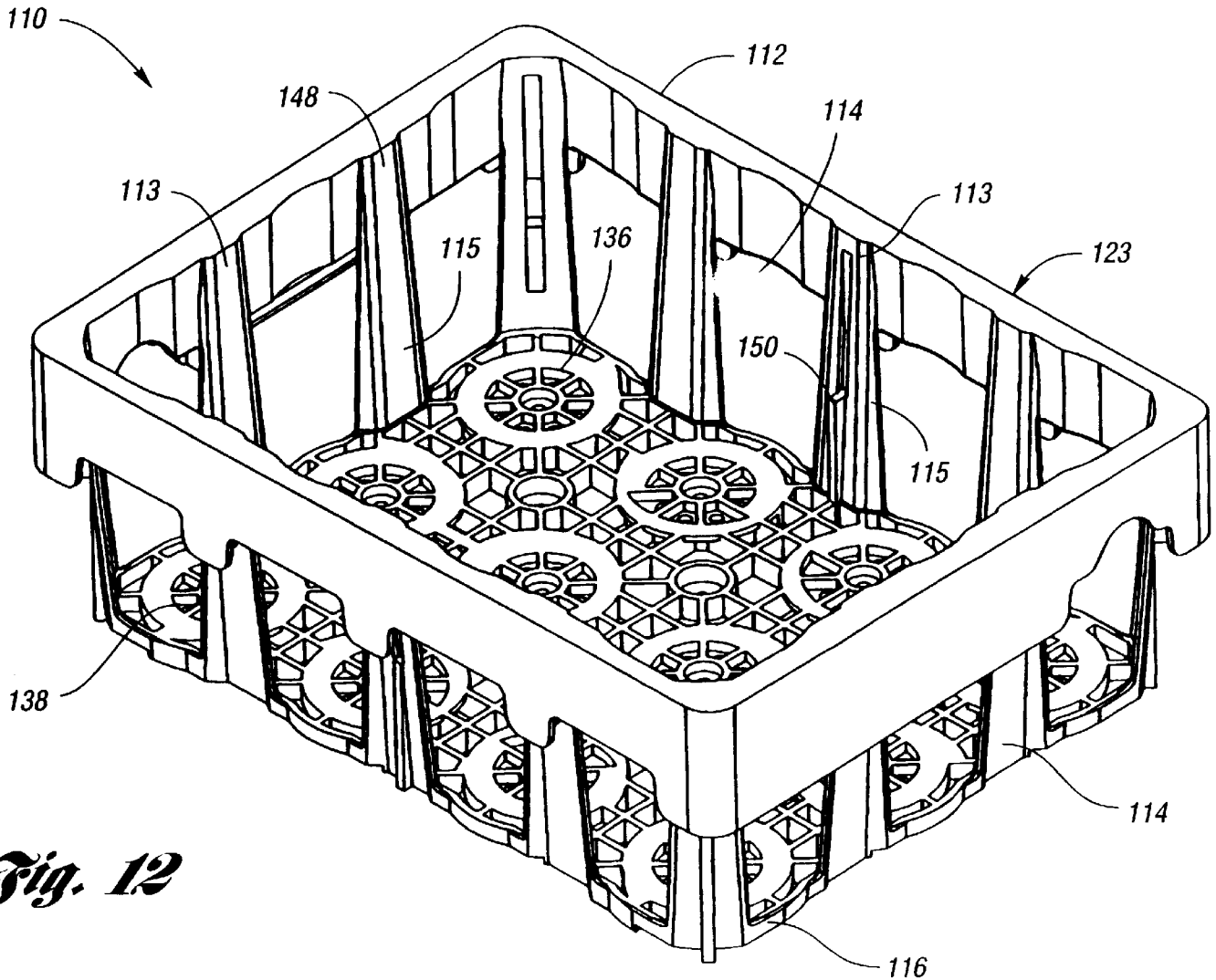
FIG. 12 is a perspective view of a second embodiment of a case according to the present invention.

As shown in FIGS. 1 and 2, side walls 12,14 each include a lower wall portion 22, and an upper wall portion 23 which in this embodiment is defined by a plurality of spaced upwardly projecting pylons 24, 26, 28, and 30, including the four corner pylons 24, 30 defining the four corners of case 10. Adjacent pylons (24 and 26, 26 and 28, 28 and 30) have situated between them a relatively lower rim 32, which said adjacent pylons and rims define a plurality of windows 34 by which the labels (sides) of the cans retained in case 10 may be easily and fully viewed. Referring to FIG. 12, a second embodiment of a case 110 according to the present invention is shown therein. As noted, case 110 includes an upper wall portion 123 which is defined primarily by a band 112 formed around the perimeter of case 110. Upper wall portion 111 also includes the upper portions 113 of the plurality of members 114. For case 110, the lower wall portion is defined by the lower portions 115 of members 114.

Referring again to FIG. 1, case 10 also includes first and second upwardly projecting columns 52 and 54. Thus, as shown in FIGS. 4*a* and 4*b*, bottom panel 20, side walls 12,14, end walls 16,18, columns 52,54 and pylons 24,26, 28,30 cooperate to form and define a plurality of can retaining pockets 36, 38, 40, 42, 44, 46 for retaining cans such as a Number 10 can which is well known in the industry and holds approximately 109 ounces of liquid. Of course, second embodiment case 110 shown in FIG. 12 may likewise have columns positioned from its bottom panel 116, similar to columns 52,54 of case 10, in order to assist in, defining container retaining pockets 136, 138.

Figure 6:
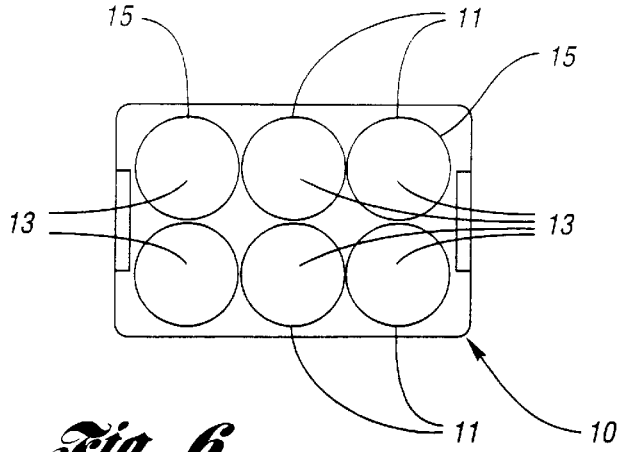
FIG. 6 shows an overhead plan view of a case loaded with cans in accordance with the embodiment of FIG. 1.
Figure 7:
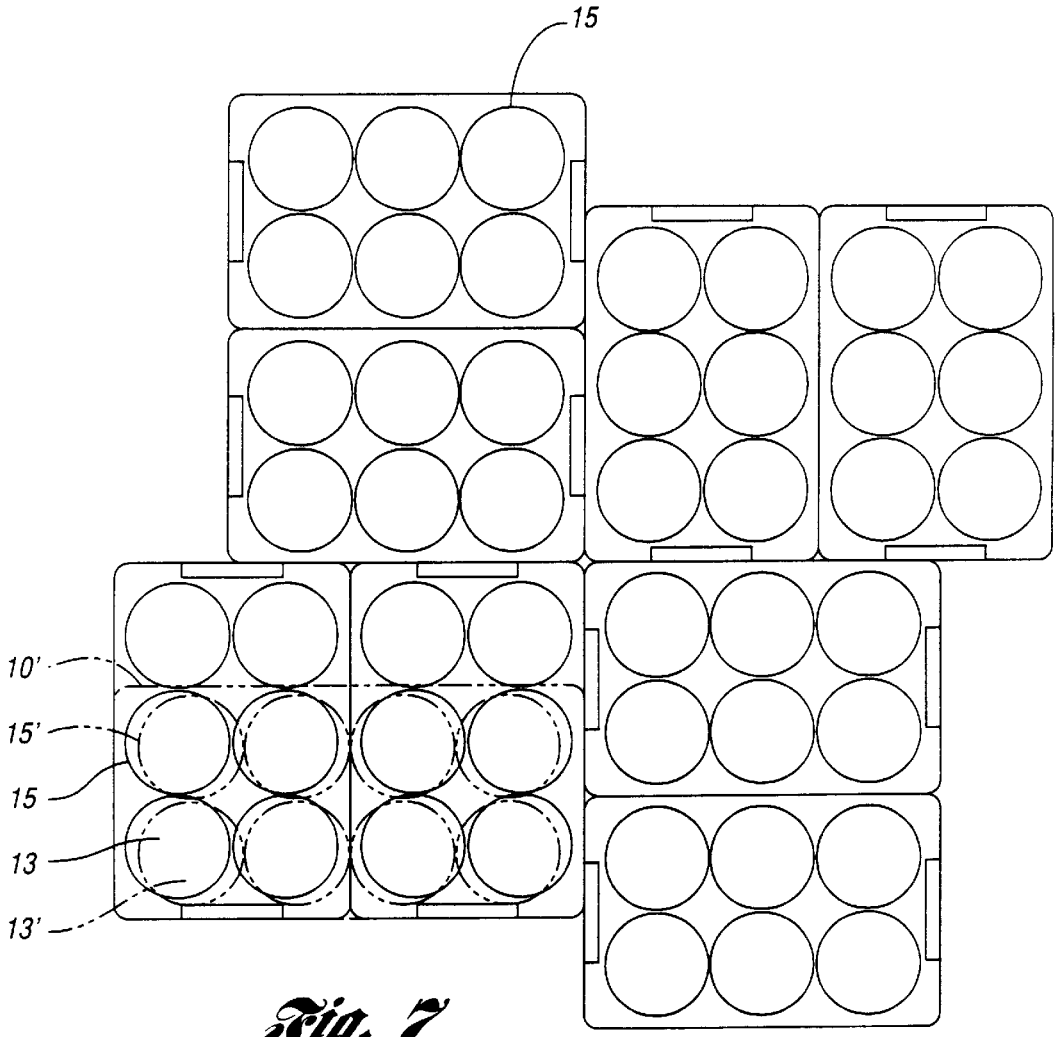
FIG. 7 shows an overhead plan view of a plurality of stacked and cross-stacked cases loaded with cans in accordance with the embodiment of FIG. 1.
Figure 11:
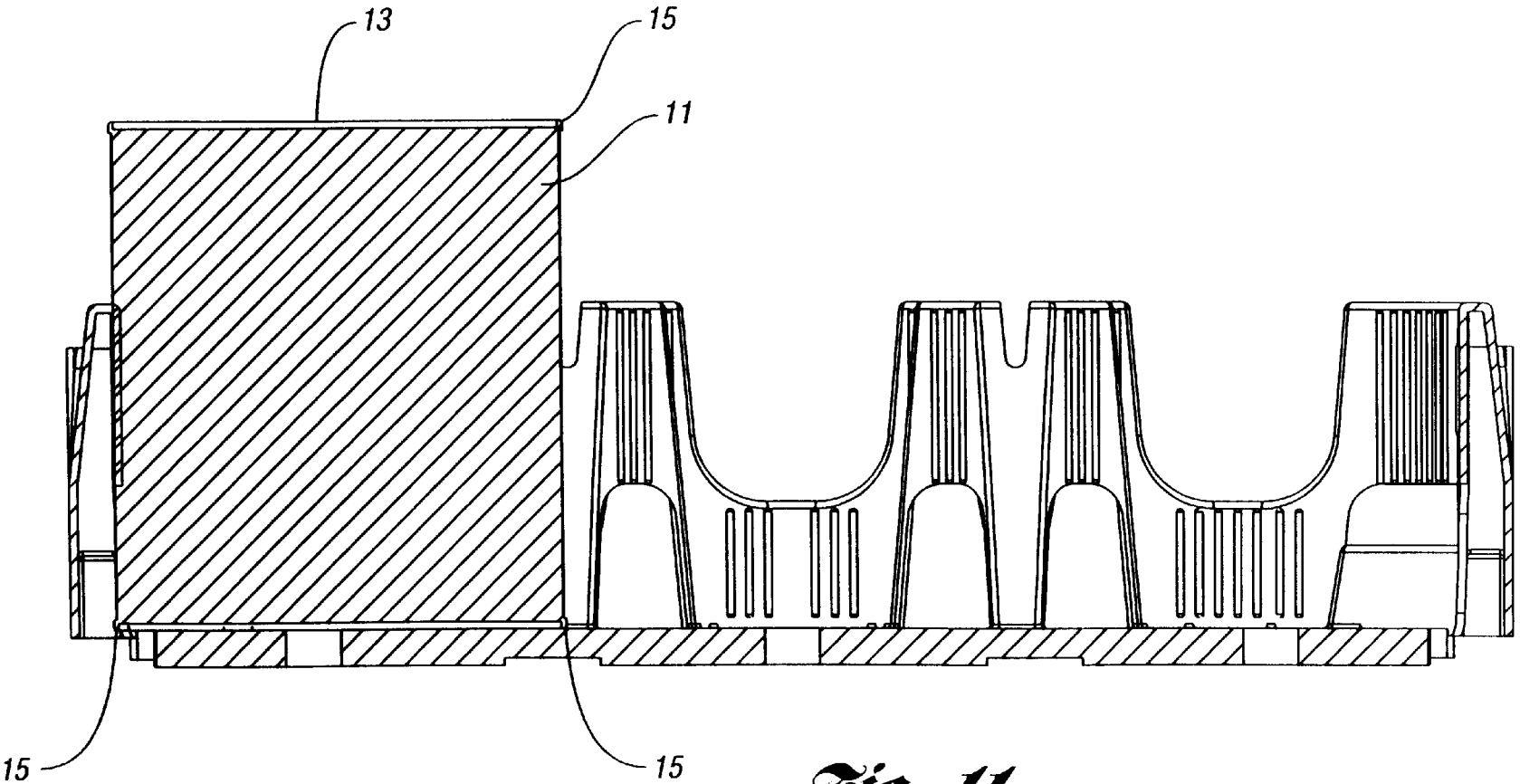
FIG. 11 is a sectional view taken through a case and a container retained in the case, according to the present invention.

In accordance with the present invention and as best illustrated in FIGS. 1 and 6–7, case 10 includes at least one—and preferably a plurality of—retention members which are preferably, but not necessarily, raised projections or ribs integrally molded thereon for retaining and transporting cans 11 in a secure manner. More particularly, a plurality of preferably raised vertical ribs 48 are disposed on the lower portions of side walls 12,14 below window 34 and proximate rim 32. A plurality of similar raised retention members 50 are disposed on pylons 24, 26, 28, 30. A gap 51 (or recess) is oriented between the plane defined by the upper surface of bottom panel 20 and the plane defined by the low edges of the plurality of ribs 48. During use of case 10, a lip 15 of can 11 is positioned securely in gap 51, so that can 11 is retained securely in case 10 (see FIGS. 1, 7 and particularly the cross-section through a typical container 11 as shown in FIG. 11.) As illustrated in FIG. 12, case 110 may have a retention member which is a planar surface—such as planar surface 148—projecting inward toward the center of case 110 for retaining the container stored therein. As illustrated, planar surface 148 in the embodiment of FIG. 12, extends from upper wall portion 111 to the lower wall portion 115. Retention member may also be a raised projection such as rib 150.

For a can, lip 15 is typically a rolled edge that also seals the top and bottom lids onto the cylindrical portion of a can. For a Number 10 can, gap 51 is approximately 0.100 of an inch. In the case of bottles, ribs 48,50 may be appropriately sized and spaced to create a gap sufficient to retain a portion of a bottle such as, for example, about the bottom bulbous portion or other suitable location. Depending on the application, ribs 48,50 may also be oriented horizontally or in any other suitable direction so long as the desired gap 51 is created for retention of the corresponding container.

Sealed cans 11 which are used for containing canned goods (and most commonly food products) from the packaging plant to the market to the consumer, are typically formed of aluminum or steel. As is recognized by consumers and the industry alike, these cans are cylindrical and have ends sealed by lids 13 (disks), and also have lips 15 at each end which slightly protrudes radially outward from the edge of the can. Lips 15 serve to provide an edge onto which a can opener may grasp while opening the can, and also protects the label on the can during packing and shipping of the cans. For example, the Number 10 can has a lip which protrudes approximately 0.050 of an inch from the surface of the cylindrical portion of the can. It is contemplated that a can today may have one edge which includes a lip (such as its upper edge) and the other edge being a non-lipped punched section. Such a can, therefore, would likely be held in case 10 upside down, so that the edge with its lip 15 is inserted first into the container retaining pocket, for example 36.

Accordingly, to retain a Number 10 can, pluralities of ribs 48 and 50 extend inwardly approximately 0.05 of an inch. Thus, during installation of can 11 into one of can retaining pockets 36–46, an end of the can is moved with sufficient force to overcome the interference fit provided by ribs 48,50 and temporarily displace the relatively flexible plastic corresponding pylons and walls from their rest position, in order to move lip 15 across and past ribs 48,50 so that lip 15 sits in gap 51. Ribs 48,50 therefore serve to securely retain cans 11 in case 10 during movement and transport, and preferably during rough handling and transport, whereupon the cans may even be held securely should case 10 be held at vertical, or in one embodiment, should case 10 be inverted and horizontal. Ribs 48,50 also provide additional torsional strength to case 10.

Figure 3:
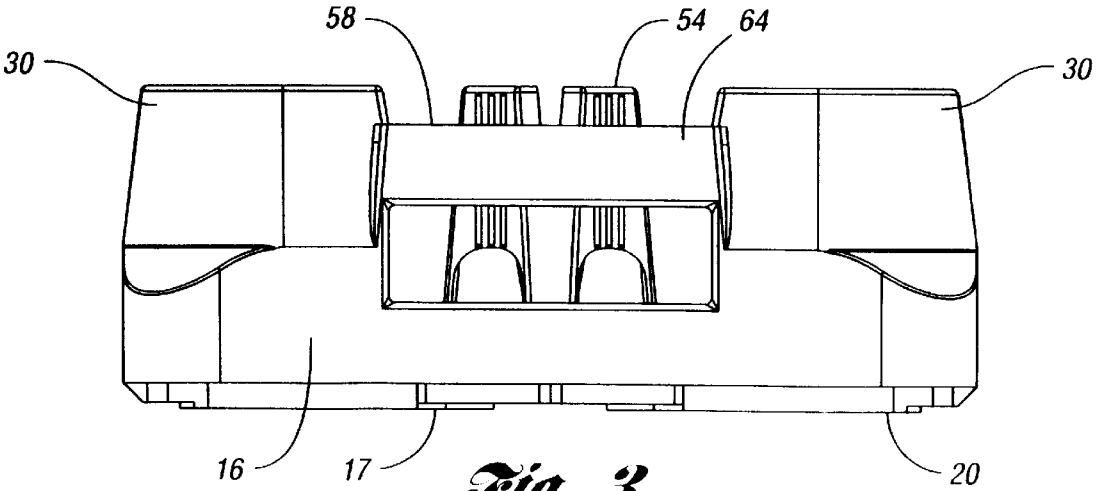
FIG. 3 shows an end elevational view of the case of FIG. 1.

Referring to FIGS. 1 and 3, end walls 16,18 each include an integrally, molded handle structure 58,60 each having interior and exterior surfaces 62,64, respectively. As shown in FIGS. 4*a* and 4*b*, handles 58,60 are each suspended between an upper portion of end wall adjacent corner pylons 24—24 and 30—30. A generally open area 76 is defined below interior and exterior surfaces 62,64 of each handle structure 58,60 and between the interior surface 62 of the handle structure 58,60 and the adjacent column 56,54 respectively, such that the handle structure 58,60 may be freely grasped about substantially the entire periphery thereof.

Referring to FIGS. 1 and 3, case 10 includes integrally molded structural reinforcement members 66,68 extending between each end wall pair of adjacent corner pylons, 30—30 and 24—24, below respective handle structures 58,60. Such structural reinforcement members 66,68 are sufficiently spaced from the respective handle structures 58,60 to prevent interference with the grasping of handle structures 58,60. Because case 10 may be subject to shipping, rough handling, fork lift manipulation, etc., it is desirable to heavily reinforce the handle ends. Structural reinforcement members 66,68 disclosed herein add significant structural integrity to case 10, thereby substantially increasing the expected usable life of case 10. A case full of six Number 10 size cans may place the ends of case 10 under significant torsional and bending forces, which adverse effects of such forces are alleviated by reinforcement members 66,68.

Figure 10:
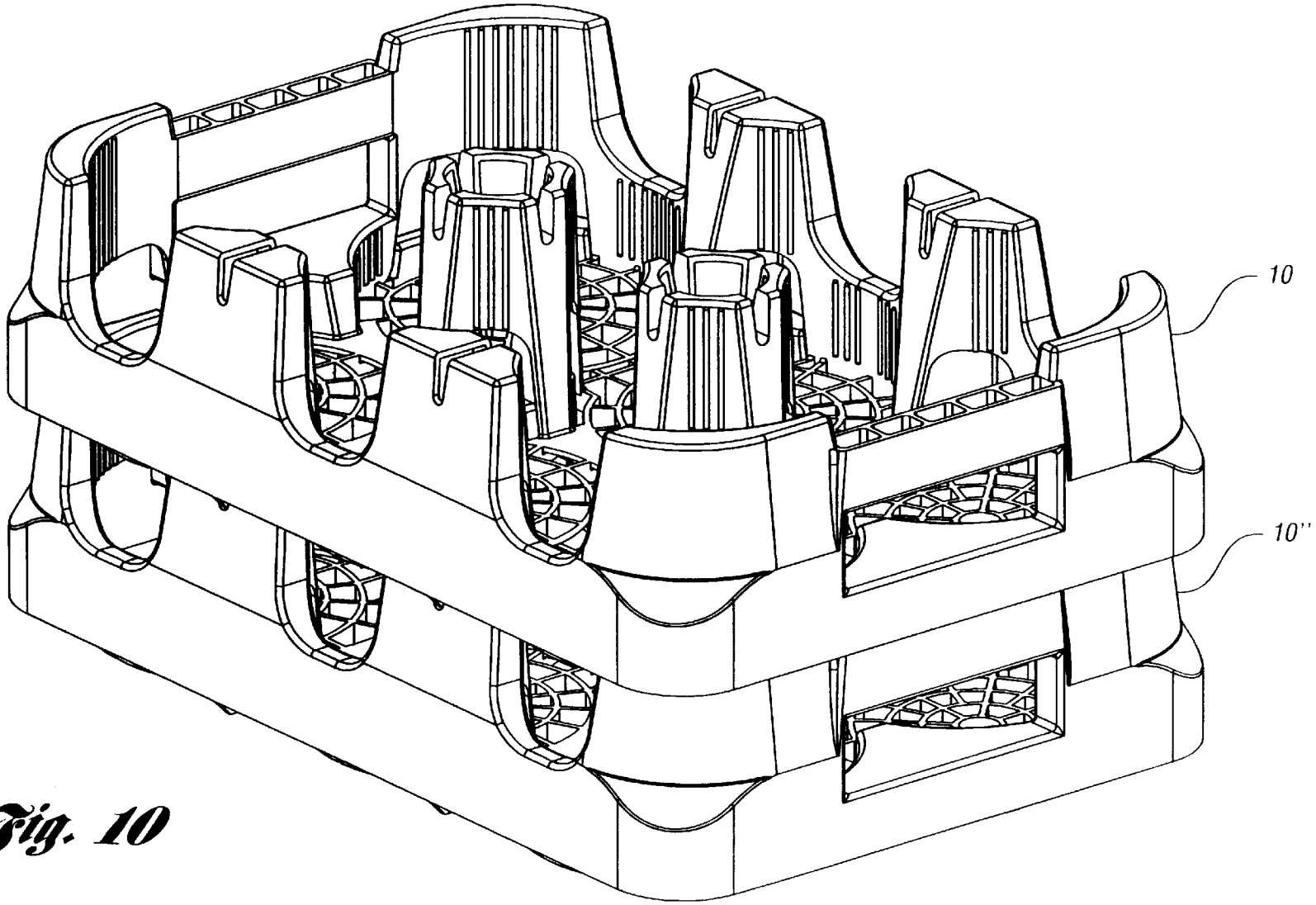
FIG. 10 is a perspective view showing two similar cases according to the present invention in a nested orientation.

As shown in FIG. 1, each reinforcement member 66,68 also includes a corresponding horizontally extending surface 72,74, respectively, which provides additional torsional strength to case 10. As shown in FIG. 1, the inner surfaces 67,69, respectively, of reinforcement members 66,68 may also have an at least one projection 55 formed thereon, similar to ribs 48. However, in some embodiments it is contemplated that projections 55 may not be necessary and, depending on the type of plastic material from which case 10 is formed, projections 55 may provide for a more torsionally stiff case than may be desired and may also create a substantially tighter fit for the containers stored therein. Handles 58,60 are spaced down approximately 1 inch from the tops of corner pylons 24,30 for improved nesting with other containers, including other cases 10 (see FIG. 10, illustrating two nested cases 10 and 10", wherein portions such as pylons, columns, etc. of one case 10 are received in corresponding openings in the adjacent bottom of another case 10".)

Turning to the bottom plan view of case 10 shown in FIG. 5, another feature according to the present invention is illustrated. As shown, each corner of case 10 includes a reinforcement rib 78, 80, 82, 84, which adds additional strength to case 10 and also prevents entry of a can lid through the bottom of the case during a stacked or cross-stacked orientation. For example, under circumstances where case 10 is slid across a plurality of cans which are supported within cases positioned thereunder, ribs 78, 80, 82, 84 would prevent entry of can lid through bottom panel 20 of case 10 because ribs 78, 80, 82, 84 are sufficiently close to adjacent ribs so that insufficient space is provided for a can lid to be hooked therein. Therefore, free sliding motion of case 10 across a plurality of stacked cans is enabled.

Figure 13A:
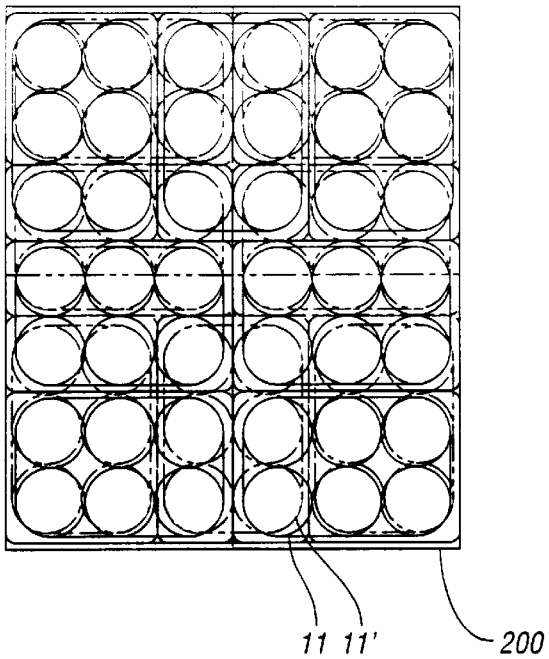
Figure 13B:
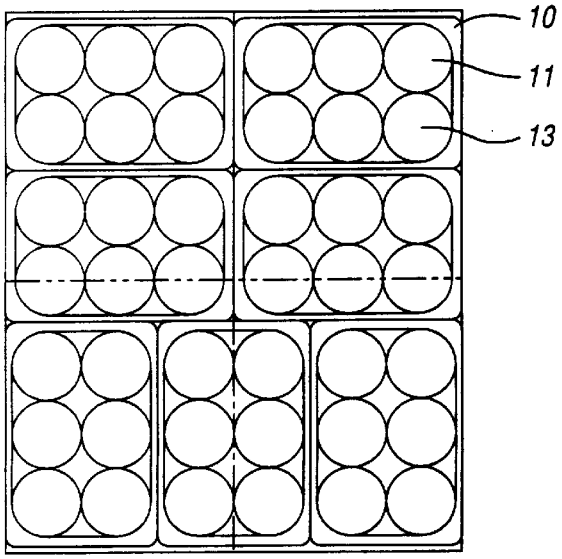
Figure 13C:
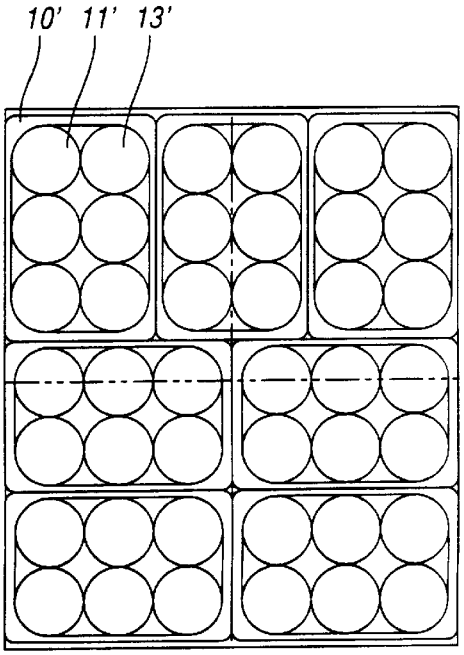

Referring to FIG. 6, illustrated is a top plan view of a case 10 loaded with containers 11 having lids 13. FIGS. 7 and 13*a–c* illustrates a layer of stacked cases 10 loaded with containers 11. In this configuration, container pockets 36–46 are arranged so that containers 11 contact each other when the case is loaded, thereby minimizing the size of each case. However, when the cases are cross-stacked, as illustrated by the case 10' shown in dashed lines, container lids 13,13' of the stacked cases are misaligned throughout the cross-stacked pallets. FIG. 13*a* illustrates a pallet 200 having two layers of cases 10 stacked (overlaid) thereon, such as cases 10 of layer 1 (holding containers 11) and cases 10' of layer 2 (holding containers 11') shown in FIGS. 13*b* and 13*c*, respectively. Thus, FIG. 13*a* reflects the stacked and cross-stacked nature of a plurality of cases 10 and 10', as described in FIG. 7. FIG. 13*a* particularly illustrates the effect of the elliptical nature of bottom panel area 17 during stacking and cross-stacking, as illustrated by the positions of containers 11 and 11' with respect to each other.

Figure 8:
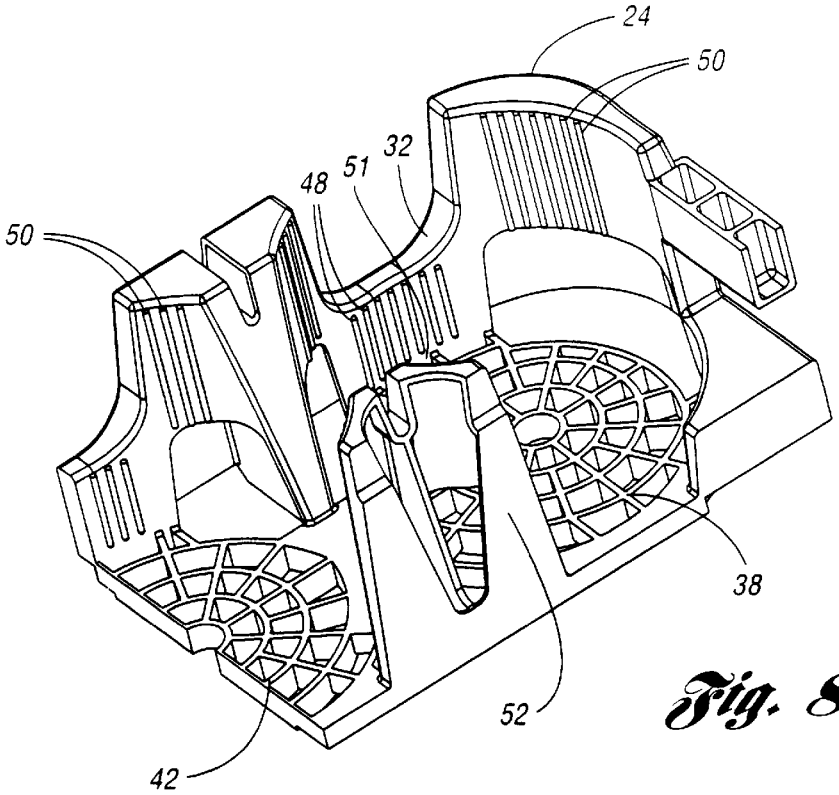
FIG. 8 is a partial top perspective view of the case according to the present invention, with focus on a corner portion of the case.
Figure 9:
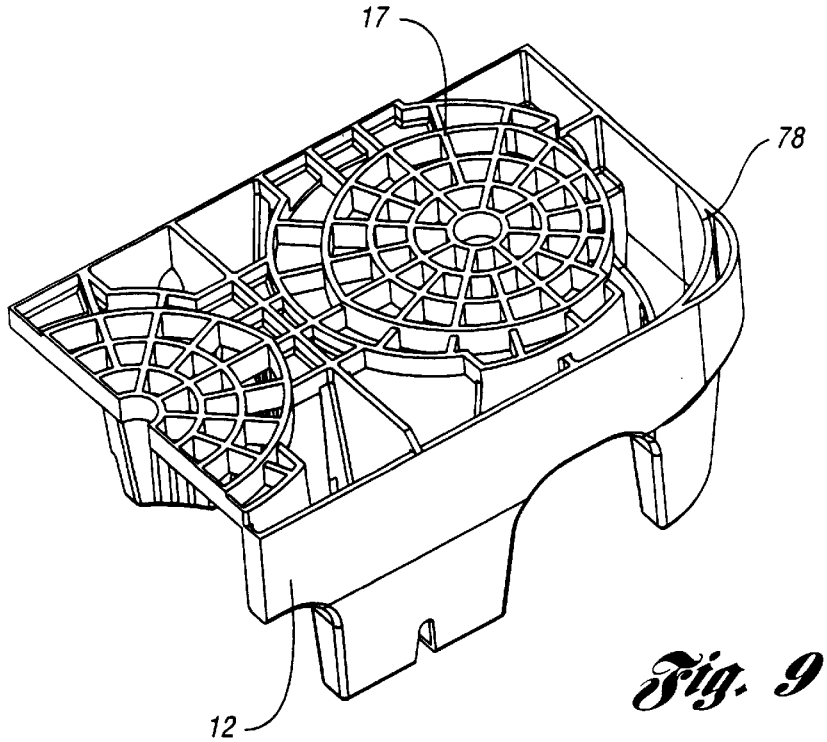
FIG. 9 is a partial bottom perspective view of the case according to the present invention, with focus on a corner portion of the bottom panel.

To accommodate more secure stacking and cross-stacking of cases 10, bottom panels 20 have substantially elliptical lid-locating areas 17 as shown in FIGS. 2, 3, 5 and 9. Further, as shown in FIGS. 2 and 8, elliptical areas 17 project downward from the bottom surface 19 of bottom panel 20, to be received by container lids 13 (inward of the slightly raised periphery defined by lip 15 or rim 15) of containers 11 which are positioned in a case immediately below, for improved stacking stability. Elliptical area 17 thus provides for approximately 130° to 150° of circumferential contact and containment for the can lid and lip during stacking and cross-stacking. It is contemplated that, given the particular design of case 10, area 17 may also have a more circular design providing even greater circumferential contact with the containers stacked below.

Figure 14:
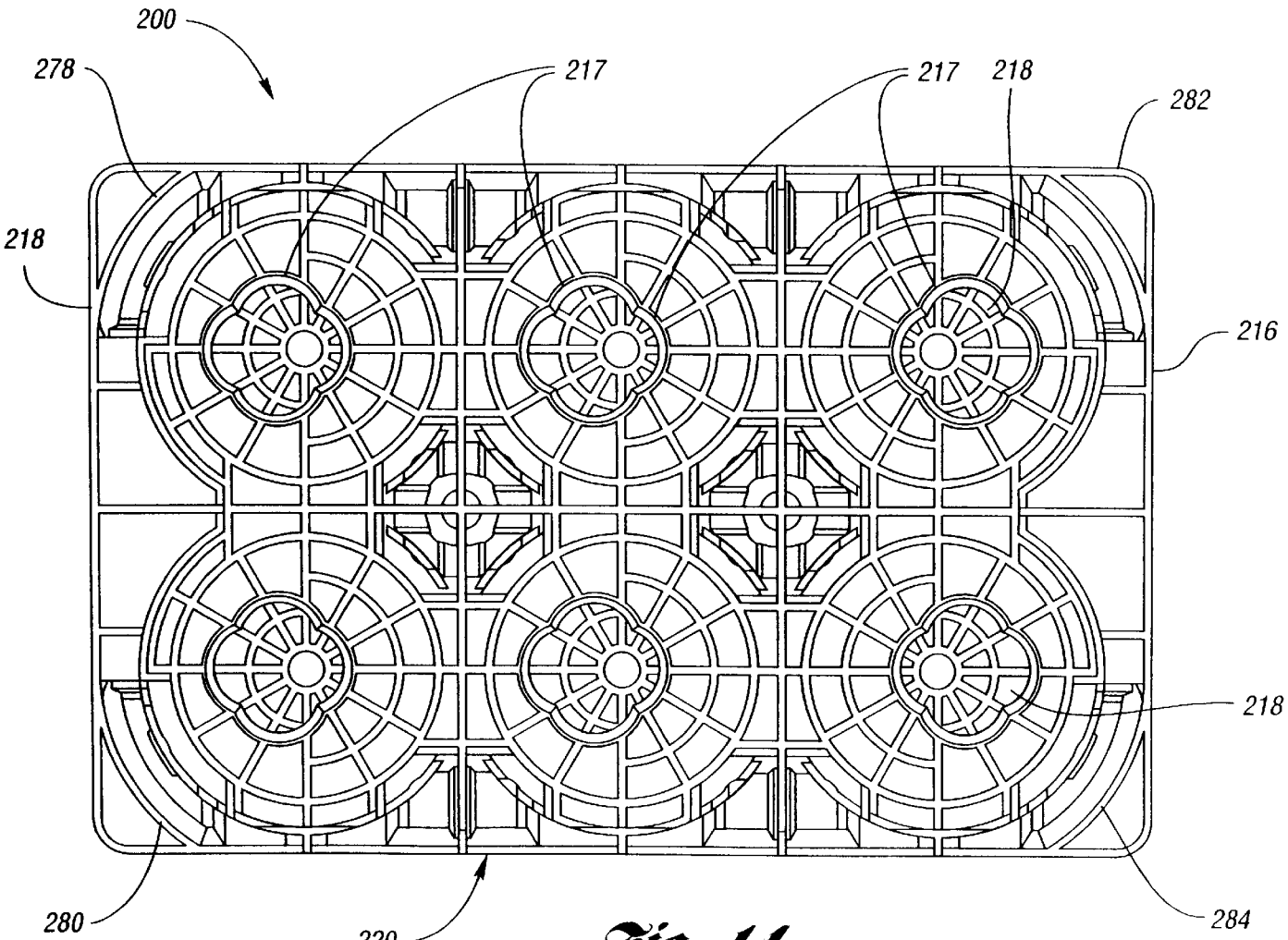
FIG. 14 illustrates a top plan view of another embodiment of a bottom surface of a case bottom panel member according to the present invention.

Of course, it is fully contemplated according to the present invention that the bottom panel may have a different configuration should the desired container supported by the case disclosed herein not have a lip or rim on its upper edge for providing a perimeter to and for receiving elliptical area 17 therein. Accordingly, with reference to FIG. 14, case 210 has a bottom panel member 220 which includes ribs or other projections 217 projecting downward from bottom panel member 220 for defining an area 218 therein for receiving the upper portion of a container therein, thereby providing a perimeter boundary support to the top portion of the container below.

While the best modes for carrying out the invention have been described in detail, those familiar with the art to which this invention relates will recognize the various alternative designs and embodiments for practicing the invention within the scope of the appended claims.

What is claimed is:

1. A stackable case for retaining and transporting containers having radially outward projecting lids, comprising:

a bottom panel member having a lower surface and an upper surface with a plurality of container support areas therein;

a pair of opposing side walls and a pair of opposing end walls integrally formed with and projecting upward from the bottom panel member, the side walls including a lower wall portion and a plurality of spaced upwardly projecting pylons which includes four corner pylons defining four comers of the case, the lower wall portion having a plurality of raised projections disposed thereon and defining a lower plane sufficiently spaced from the upper surface of the bottom panel member to receive the lid of the container securely therebetween;

at least one column member upwardly projecting from the bottom panel member and defining, in combination with the bottom panel member, the pair of opposing side walls, the pair of opposing end walls, and the container support areas, a plurality of container retention pockets.

2. The stackable case of claim 1 wherein the end walls each include an integrally molded handle structure having interior and exterior surfaces suspended between an upper portion of adjacent corner pylons, a generally open area defined below the interior and exterior surfaces of the handle structure and between said interior surface of the handle structure and the at least one column such that the handle structure may be freely grasped about substantially the entire periphery thereof.

3. The stackable case of claim 2, wherein the end walls each include an integrally molded structural reinforcement member extending between the adjacent corner pylons below the respective handle structure and sufficiently spaced from the respective handle structure to prevent interference with the grasping of the handle structure.

4. The stackable case of claim 3, wherein the structural reinforcement members having an inner surface with a second plurality of ribs projecting therefrom which are spaced apart from the upper surface of the bottom panel member for receiving a container lid therebetween.

5. The stackable case of claim 1, wherein the bottom panel member includes a bottom surface having at least one lid-locating area integrally formed therewith and projecting therefrom, the lid-locating area for being received by a container lid in an adjacent stackable case.

6. The stackable case of claim 1, wherein the pair of opposing side walls and the pair of opposing end walls form an outer shell and wherein the bottom panel member is disposed substantially within the outer shell.

7. The stackable case of claim 1, wherein the at least one column member and said pylons extend above the lower wall portions.

8. The stackable case of claim 1, wherein the plurality of raised projections are vertically oriented.

9. The stackable case of claim 1, wherein each of the pylons includes a second plurality of raised ribs formed integrally therewith and inwardly directed toward a corresponding container retention pocket for providing an interference fit for containers inserted therein.

* * * * *